US012800157B2

(12) United States Patent
Kwon et al.

(10) Patent No.: US 12,800,157 B2
(45) Date of Patent: Nov. 17, 2026

(54) AIR CONDITIONER

(71) Applicant: Samsung Electronics Co., Ltd., Suwon-si (KR)

(72) Inventors: Junseok Kwon, Suwon-si (KR); Wooyoung Park, Suwon-si (KR); Moonsun Shin, Suwon-si (KR); Kyeongae Lee, Suwon-si (KR); Wonhee Lee, Suwon-si (KR); Changsik Lee, Suwon-si (KR); Changwoo Jung, Suwon-si (KR); Sunghyun Chun, Suwon-si (KR); Sukho Kang, Suwon-si (KR); Jungyong Sung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 278 days.

(21) Appl. No.: 18/338,913

(22) Filed: Jun. 21, 2023

(65) Prior Publication Data

US 2023/0332777 A1 Oct. 19, 2023

Related U.S. Application Data

(63) Continuation of application No. PCT/KR2021/019068, filed on Dec. 15, 2021.

(30) Foreign Application Priority Data

Jan. 21, 2021 (KR) ..... 10-2021-0008937

(51) Int. Cl.
*F24F 1/0284* (2019.01)

(52) U.S. Cl.
CPC ..... *F24F 1/0284* (2019.02)

(58) Field of Classification Search
CPC .. F24F 1/0284; F24F 1/0018; F24F 2013/205; F24F 13/20
See application file for complete search history.

(56) References Cited

U.S. PATENT DOCUMENTS 4,392,525 A * 7/1983 O'Mara ..... F24F 13/00 165/125
4,973,016 A * 11/1990 Hertenstein ..... F21V 21/108 248/282.1

(Continued)

FOREIGN PATENT DOCUMENTS

CN 1773125 A 5/2006
CN 2891208 Y 4/2007

(Continued)

OTHER PUBLICATIONS

International Search Report dated Apr. 15, 2022, issued in International Application No. PCT/KR2021/019068.

(Continued)

*Primary Examiner* — Allen R. B. Schult
(74) *Attorney, Agent, or Firm* — Jefferson IP Law, LLP

(57) ABSTRACT

An air conditioner capable of allowing a user to safely and easily clean a fan and a duct is provided. The air conditioner includes a fan assembly comprising a fan configured to suction and discharge air, a drive motor configured to rotate the fan, a fan frame to which the fan and the drive motor are mounted, and including a wire groove, and a wire connected to the drive motor to supply power to the drive motor, wherein at least a portion of the wire is disposed inside the wire groove, and a duct.

22 Claims, 17 Drawing Sheets

(56) References Cited

U.S. PATENT DOCUMENTS

| | | | | |
|---|---|---|---|---|
| 7,311,492 | B2 | 12/2007 | Ostberg | |
| 9,702,576 | B2 * | 7/2017 | Avedon | F24F 7/007 |
| 9,752,816 | B2 * | 9/2017 | Hwang | F04D 29/4253 |
| 11,022,325 | B2 | 6/2021 | Lee et al. | |
| 11,662,102 | B2 | 5/2023 | Kim et al. | |
| 12,372,253 | B2 | 7/2025 | Bae et al. | |
| 2015/0176851 | A1 | 6/2015 | Avedon | |
| 2020/0408433 | A1 | 12/2020 | Gyeong et al. | |
| 2021/0062818 | A1 | 3/2021 | Wang et al. | |
| 2021/0396398 | A1 | 12/2021 | Yoon et al. | |

FOREIGN PATENT DOCUMENTS

| | | | | |
|---|---|---|---|---|
| CN | 111811050 | A | 10/2020 | |
| CN | 111819396 | A | 10/2020 | |
| EP | 2 233 852 | A1 | 9/2010 | |
| EP | 2 602 561 | B1 | 3/2020 | |
| EP | 3 767 193 | A1 | 1/2021 | |
| JP | H09-158593 | A | 6/1997 | |
| JP | 2002-005469 | A | 1/2002 | |
| JP | 4309450 | B2 | 8/2009 | |
| JP | 2012-107806 | A | 6/2012 | |
| KR | 10-0482288 | B1 | 4/2005 | |
| KR | 10-1116396 | B1 | 3/2012 | |
| KR | 20-0464840 | Y1 | 1/2013 | |
| KR | 10-2013-0043983 | A | 5/2013 | |
| KR | 10-2014-0012437 | A | 2/2014 | |
| KR | 10-2017-0076005 | A | 7/2017 | |
| KR | 10-1952720 | B1 | 2/2019 | |
| KR | 10-2019-0086972 | A | 7/2019 | |
| KR | 10-2003608 | B1 | 7/2019 | |
| KR | 10-2076668 | B1 | 2/2020 | |
| KR | 10-2020-0022862 | A | 3/2020 | |
| KR | 10-2020-0131019 | A | 11/2020 | |
| KR | 20200131019 | A * | 11/2020 | H02G 3/02 |

OTHER PUBLICATIONS

Korean Office Action dated Sep. 22, 2023, issued in Korean Application No. 10-2023-0022376.

Notice of Submission of Opinion dated Nov. 4, 2025, issued in Korean Application No. 10-2021-0008937.

Chinese Office Action dated Feb. 9, 2026, issued in Chinese Application No. 202180090414.6.

Chinese Office Action dated Jun. 30, 2026, issued in Chinese Application No. 202180090414.6.

* cited by examiner

AIR CONDITIONER

CROSS-REFERENCE TO RELATED APPLICATION(S)

This application is a continuation application, claiming priority under § 365(c), of an International application No. PCT/KR2021/019068, filed on Dec. 15, 2021, which is based on and claims the benefit of a Korean patent application number 10-2021-0008937, filed on Jan. 21, 2021, in the Korean Intellectual Property Office, the disclosure of which is incorporated by reference herein in its entirety.

BACKGROUND

1. Field

The disclosure relates to an air conditioner. More particularly, the disclosure relates to an air conditioner including an improved structure to facilitate cleaning of a fan, and a flow path inside a duct.

2. Description of Related Art

In general, an air conditioner is a device that uses a refrigeration cycle to adjust temperature, humidity, airflow, distribution, etc. suitable for human activity. A compressor, a condenser, an evaporator, an expansion valve, etc. are provided as main components forming the refrigeration cycle.

The air conditioner may include a fan and a duct forming a flow path for guiding air flowing by the fan. When the fan or flow path is contaminated, the air discharged from the air conditioner may be contaminated.

According to the related art, when accessing an inside of an air conditioner to clean a fan or flow path, a connector for supplying power to a motor configured to rotate the fan is exposed to the outside. Because a current flows through the connector even when the air conditioner is not operating, a user may be electrocuted due to contact with the connector. Accordingly, for safe cleaning, the disconnection of the connector had to be preceded. However, there is a risk of electric shock to a user when the user disconnects the connector, and thus the disconnection has to be performed by an expert.

Further, in a conventional manner, after disconnecting the connector to clean the fan or the flow path, the fan and the motor had to be completely separated from the main body. For this reason, the ease of cleaning was reduced.

Recently, there is a growing need for users to clean the fan or flow path disposed inside the air conditioner by themselves. Accordingly, safe and easy access to the fan or flow path is required.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an air conditioner capable of, when accessing a fan or a flow path inside a duct, safely accessing the fan or the flow path by preventing a connector from being exposed to an outside.

Another aspect of the disclosure is to provide an air conditioner capable of, when cleaning a fan or a flow path inside a duct, easily cleaning the fan or the flow path because it is not required to disconnect a connector for supplying power to a motor.

Another aspect of the disclosure is to provide an air conditioner capable of, when cleaning a fan or a flow path inside a duct, easily cleaning the fan or the flow path by maintaining a state in which the fan and a motor are coupled to a main body.

Additional aspects will be set forth in part in the description which follows and, in part, will be apparent from the description, or may be learned by practice of the presented embodiments.

In accordance with an aspect of the disclosure, an air conditioner is provided. The air conditioner includes a fan assembly including a fan configured to suction and discharge air, a drive motor configured to rotate the fan, and a fan frame to which the fan and the drive motor are mounted, and including a wire groove, and a wire connected to the drive motor to supply power to the drive motor, wherein at least a portion of the wire is disposed inside the wire groove, and a duct.

The duct may include a circular opening, and fan may be drawn from the circular opening as the fan assembly and rotationally moves with respect to the duct.

The fan frame may include a shaft provided to serve as a rotation axis of the fan assembly.

The air conditioner may further include a link provided to connect the fan assembly and the duct to allow the fan assembly to be coupled to the duct, and provided to connect the fan assembly and the duct to allow the fan assembly to linearly move and rotationally move with respect to the duct, and the link may include a shaft coupler provided to allow the shaft to be coupled thereto.

The duct may include a link coupler formed to penetrate the duct to allow the link to be inserted thereinto.

The link may further include a stopper provided to be larger than the link coupler to prevent the link from passing through the link coupler.

Based on the link moving linearly in a first direction, the link may include a body plate extending in the first direction, the shaft coupler provided at one end of the body plate, and the stopper provided at the other end of the body plate.

Based on the link moving linearly in a first direction, the link may include a plate member extending in a second direction perpendicular to the first direction, the shaft coupler provided at one end of the plate member, and a rail member provided at the other end of the plate member and extending in the first direction.

The rail member may be provided to linearly move in the first direction within the link coupler.

The rotation axis and the rail member may be provided to be spaced apart from each other by a predetermined distance in the second direction.

The fan frame may be provided to cover the flow path in response to the fan assembly being coupled to the duct.

The fan frame may include a grille member to allow air, which is introduced into the flow path, to be discharged through the fan frame.

The air conditioner may further include a connector electrically connected to the drive motor to supply electric power to the drive motor.

The fan frame may include a connector receiving member provided to receive the connector.

The air conditioner may further include a connector cover provided to cover the connector receiving member to prevent the connector from being exposed to an outside.

In response to the fan assembly linearly and rotationally moving with respect to the duct, the connector and the connector cover may be provided to linearly and rotationally move together with the fan assembly.

The air conditioner may further include a main body, and a front panel provided to cover a front surface of the main body, and including a plurality of holes provided to discharge air discharged by the fan, the front panel disposed to face the duct.

The air conditioner of claim may further include a heat exchanger disposed inside the main body.

The duct may be disposed between the front panel and the heat exchanger to face the front panel and the heat exchanger.

The air conditioner may further include a fastening member fastened to the duct to fix the fan assembly to the duct.

The fan assembly may be provided to linearly and rotationally move after the fastening of the fastening member is released.

In accordance with another aspect of the disclosure, an air conditioner is provided. The air conditioner includes a main body, a duct arranged inside the main body and including a flow path provided to guide air in the main body, a fan assembly including a fan disposed on the flow path and configured to suction and discharge air, a drive motor configured to rotate the fan, and a fan frame to which the fan and the drive motor are mounted, a connector electrically connected to the drive motor to supply electric power to the drive motor, and a connector cover provided to prevent the connector from being exposed by covering one side of the fan frame.

The air conditioner may further include a link provided to connect the fan assembly and the duct to allow the fan assembly to linearly move and rotationally move with respect to the duct.

The fan frame may include a shaft provided to serve as a rotation axis of the fan assembly.

The link may include a shaft coupler provided to allow the shaft to be coupled thereto.

The duct may include a link coupler formed to penetrate the duct to allow the link to be inserted thereinto.

The link may further include a stopper provided to be larger than the link coupler to prevent the link from passing through the link coupler.

In accordance with another aspect of the disclosure, an air conditioner is provided. The air conditioner includes a main body, a front panel provided to cover a front surface of the main body, and provided to discharge air in the main body, a duct disposed to face the front panel in the main body and including a flow path provided to guide air in the main body, and a fan assembly including a fan disposed on the flow path, a drive motor configured to rotate the fan, and a grille provided to allow the fan and the drive motor to be mounted thereto, and provided to cover the flow path. The fan assembly linearly moves and rotationally moves with respect to the duct while maintaining the coupling to the duct.

When a user accesses a fan or a flow path in a duct, the user can safely access the fan or the flow path because a connector is not exposed to an outside.

When a user cleans a fan or a flow path in a duct, the user can easily clean the fan or the flow path because it is not required to disconnect a connector for supplying power to a motor.

When a user cleans a fan or a flow path in a duct, the user can easily clean the fan or the flow path because the fan and the motor maintain a coupled state to a main body.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
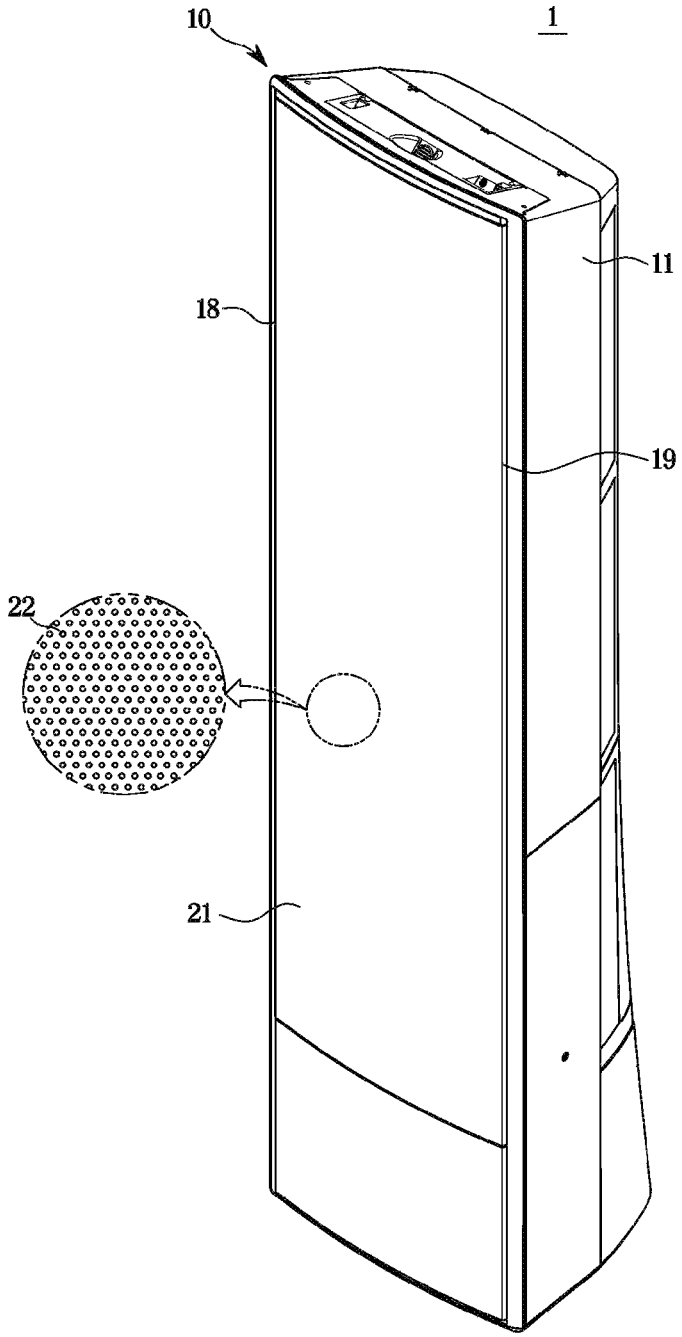
FIG. 1 is a perspective view of an air conditioner according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Shapes and sizes of elements in the drawings may be exaggerated for clear description.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element.

Hereinafter a fan frame may refer to a first grille 123, a second grille 133, and a third grille 143.

FIG. 1 is a perspective view of an air conditioner according to an embodiment of the disclosure.

Figure 2:
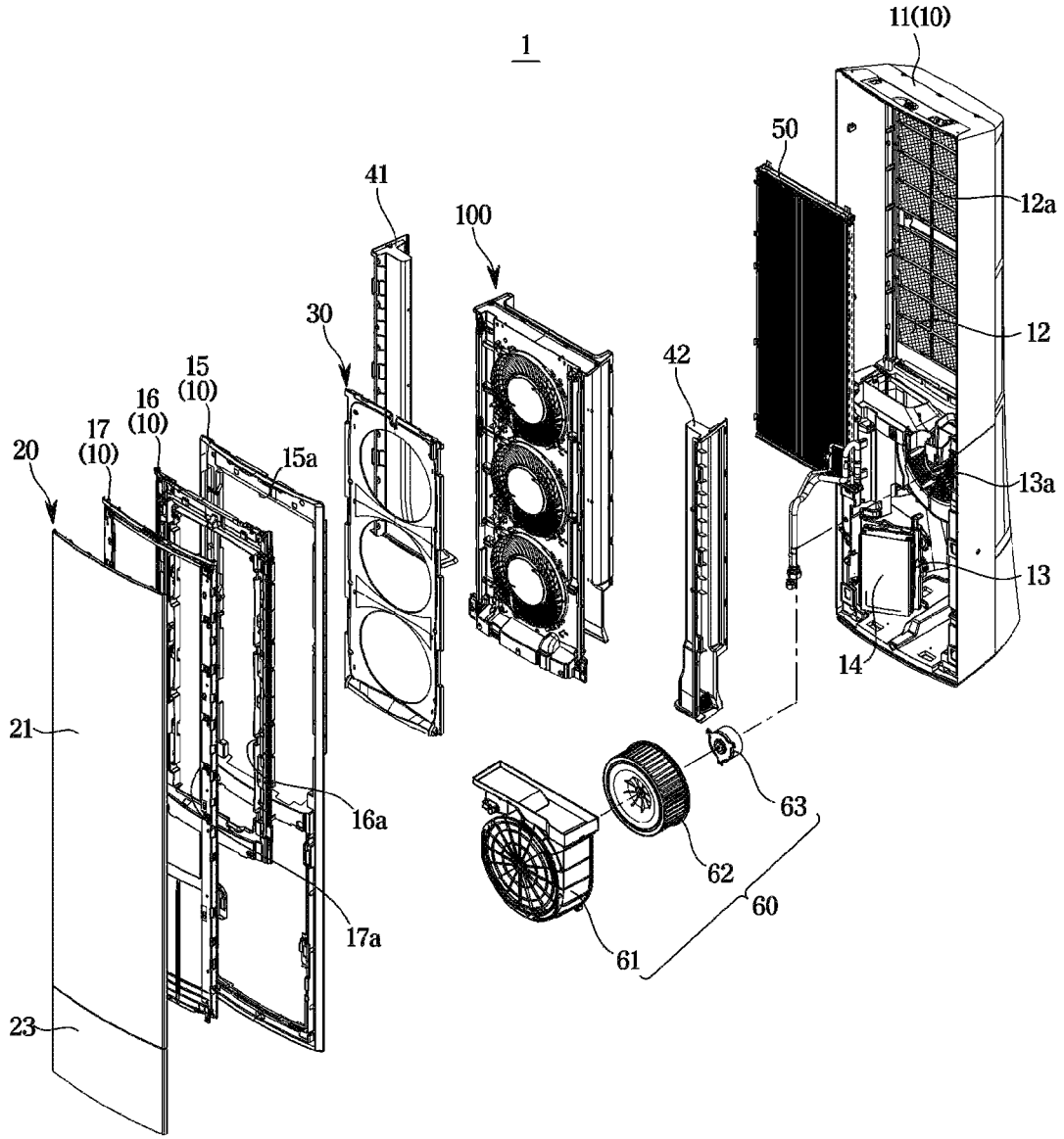
FIG. 2 is an exploded perspective view of the air conditioner according to an embodiment of the disclosure.

FIG. 2 is an exploded perspective view of the air conditioner according to an embodiment of the disclosure.

Referring to FIG. 1, an air conditioner 1 according to an embodiment of the disclosure may include a main body 10, a front panel 21 provided to cover a front surface of the main body 10 and including a plurality of holes 22, and a first guide outlet 18 and a second guide outlet 19 provided to discharge air to both sides of the front panel 21.

The air conditioner 1 according to an embodiment of the disclosure may discharge air through the plurality of holes 22 formed in the front panel 21. In addition, the air conditioner 1 may discharge air through the first guide outlet 18 and the second guide outlet 19 disposed on both sides of the front panel 21. Air discharged through the plurality of holes 22 of the front panel 21 may be discharged at a low speed in a wide area. On the other hand, the air discharged through the first guide outlet 18 and the second guide outlet 19 may be discharged relatively faster and further.

Referring to FIG. 2, the air conditioner 1 according to an embodiment of the disclosure may include the main body 10, a heat exchanger 50 disposed inside the main body 10, a duct assembly 100, the front panel 21 provided to cover the front surface of the main body 10, a second duct 41 including the first guide outlet 18, a third duct 42 including the second guide outlet 19, and a blower 60 configured to discharge air to the second duct 41 and the third duct 42.

The main body 10 may include a housing 11 forming an upper surface, both side surfaces, and a lower surface of the main body 10. The housing 11 may include a first receiving space 12 provided in an upper portion of the inner space, and a second receiving space 13 provided below the first receiving space 12. The first receiving space 12 may include a first inlet 12*a*, and the first inlet 12*a* may be disposed on an upper side of a rear surface of the housing 11. The second receiving space 13 may include a second inlet 13*a*, and the second inlet 13*a* may be disposed on a lower side of the rear surface of the housing 11.

The first receiving space 12 may receive the heat exchanger 50 configured to cool air introduced into the housing 11 from the outside through the first inlet 12*a*. The heat exchanger 50 may include an evaporator.

The blower 60 may be disposed in the second receiving space 13. The blower 60 may suck external air into the housing 11 through the second inlet 13*a*. The blower 60 may suck outside air into the second receiving space 13 through the second inlet 13*a* and then discharge the outside air to the second duct 41 and the third duct 42. The air introduced into the second duct 41 and the third duct 42 by the blower 60 may be discharged to the outside of the main body 10 through the first guide outlet 18 and the second guide outlet 19.

The blower 60 may include a fan frame 61 in which one side surface and an upper surface are open, a fan 62 rotatably installed in the fan frame 61, and a drive motor 63 configured to rotate the fan 62.

The duct assembly 100 may be disposed in front of the heat exchanger 50. The duct assembly 100 may include fan assemblies 120, 130, and 140 configured to suction external air through the first inlet 12*a* and configured to discharge the air to a front panel 20, and a first duct 110 to which the fan assemblies 120, 130, and 140 are mounted and including flow paths 111*a*, 112*a*, and 113*a*. The duct assembly 100 will be described later.

The second duct 41 and the third duct 42 may be disposed on both sides of the first duct 110. The first duct 110 and the second duct 41 may form different flow paths. Similarly, the first duct 110 and the third duct 42 may form different flow paths.

A cover panel 30 may be disposed in front of the duct assembly 100. The cover panel 30 may cover a front surface 110*a* (refer to FIG. 4) of the first duct 110 when the front panel 20 is removed from the main body 10.

The main body 10 may include a first frame 15 coupled to the open front surface of the housing 11, a second frame 17 coupled to a front surface of the first frame 15, and a support from 16 arranged between the first frame 15 and the second frame 17 so as to support the first frame 15 and the second frame 17.

The first frame 15 may include a first outlet 15*a*, and the support frame 16 may include a second outlet 16*a* corresponding to the first outlet 15*a*. In addition, the second frame 17 may include a third outlet 17*a* corresponding to the first outlet 15*a* and the second outlet 16*a*.

As mentioned above, the front panel 20 may include the plurality of holes 22. Particularly, the front panel 20 may include a discharge region including the plurality of holes 22 and a blocking region 23 not including a hole. Because the blocking region 23 does not include a hole, air at the rear side of the front panel 20 may not pass through the blocking region 23. Air from the rear side of the front panel 20 may be discharged to the front side of the front panel 20 by passing through the plurality of holes 22 of the discharge region.

Figure 3:
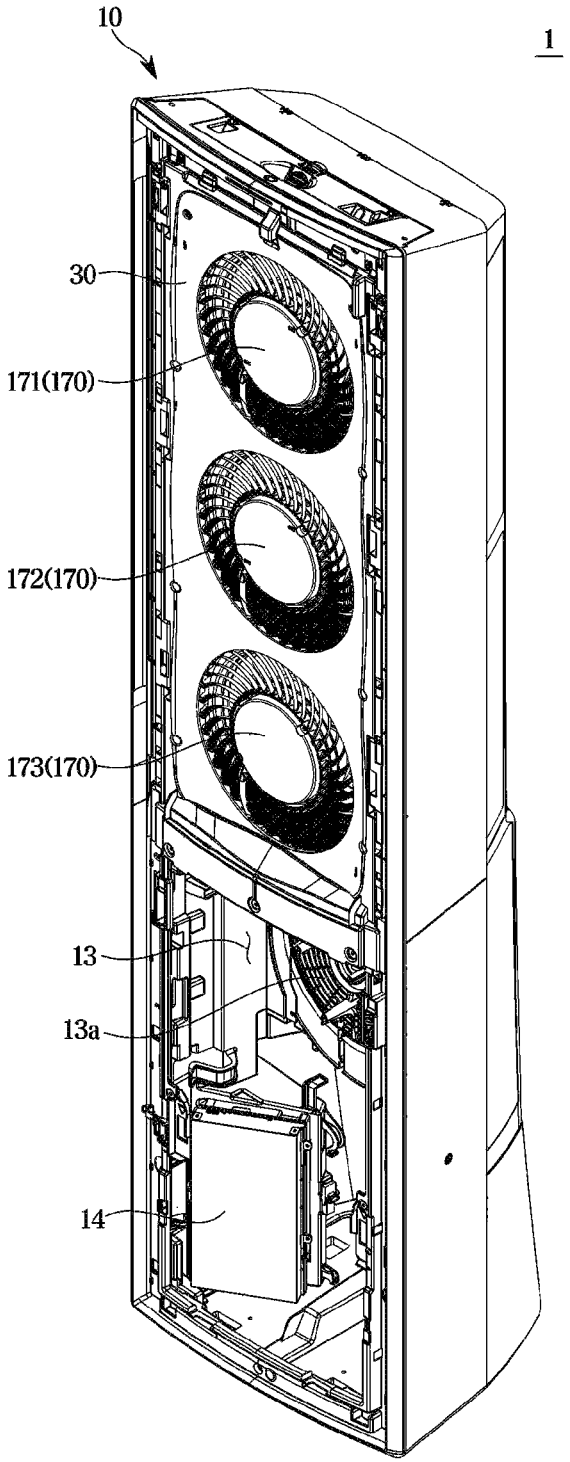
FIG. 3 is a view illustrating a state in which a front panel is removed from the air conditioner according to an embodiment of the disclosure.

FIG. 3 is a view illustrating a state in which a front panel is removed from the air conditioner according to an embodiment of the disclosure.

Figure 4:
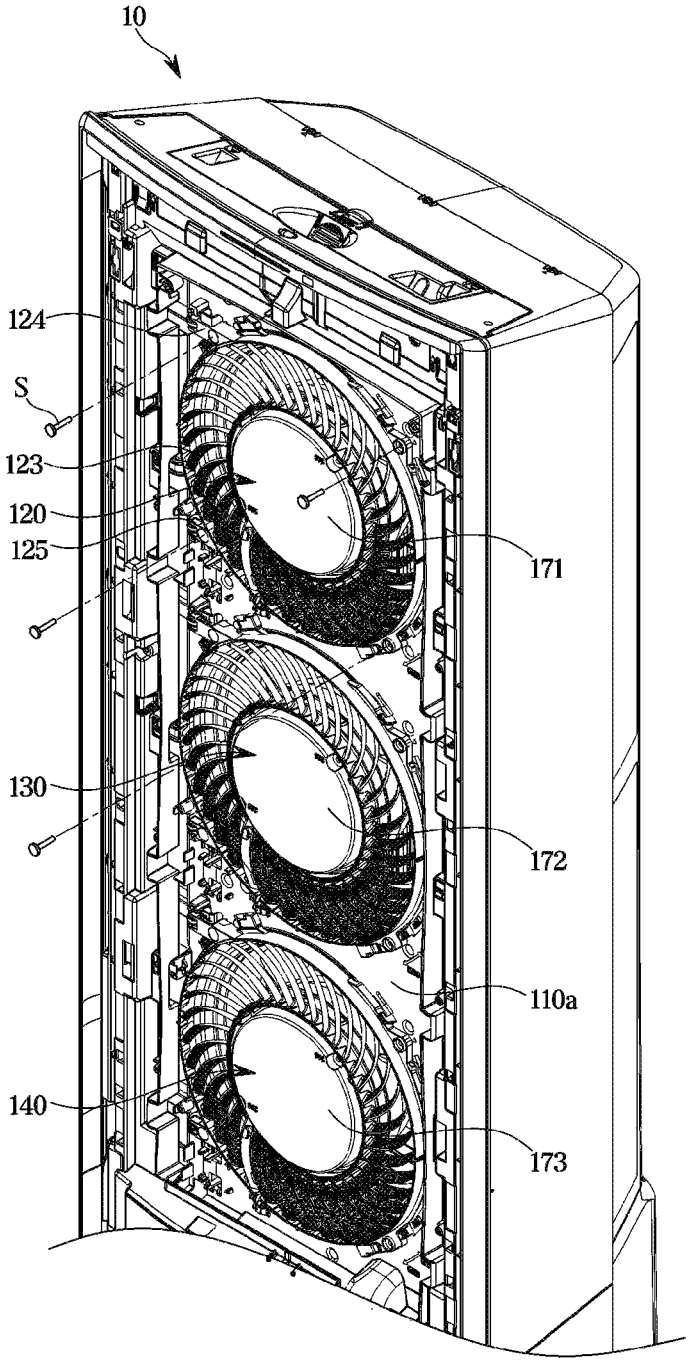
FIG. 4 is a view illustrating a state in which a cover panel is removed from the air conditioner shown in FIG. 3, particularly a view illustrating a state in which a fastening member of a fan assembly is disassembled according to an embodiment of the disclosure.

FIG. 4 is a view illustrating a state in which a cover panel is removed from the air conditioner shown in FIG. 3, particularly a view illustrating a state in which a fastening member of a fan assembly is disassembled according to an embodiment of the disclosure.

Figure 5:
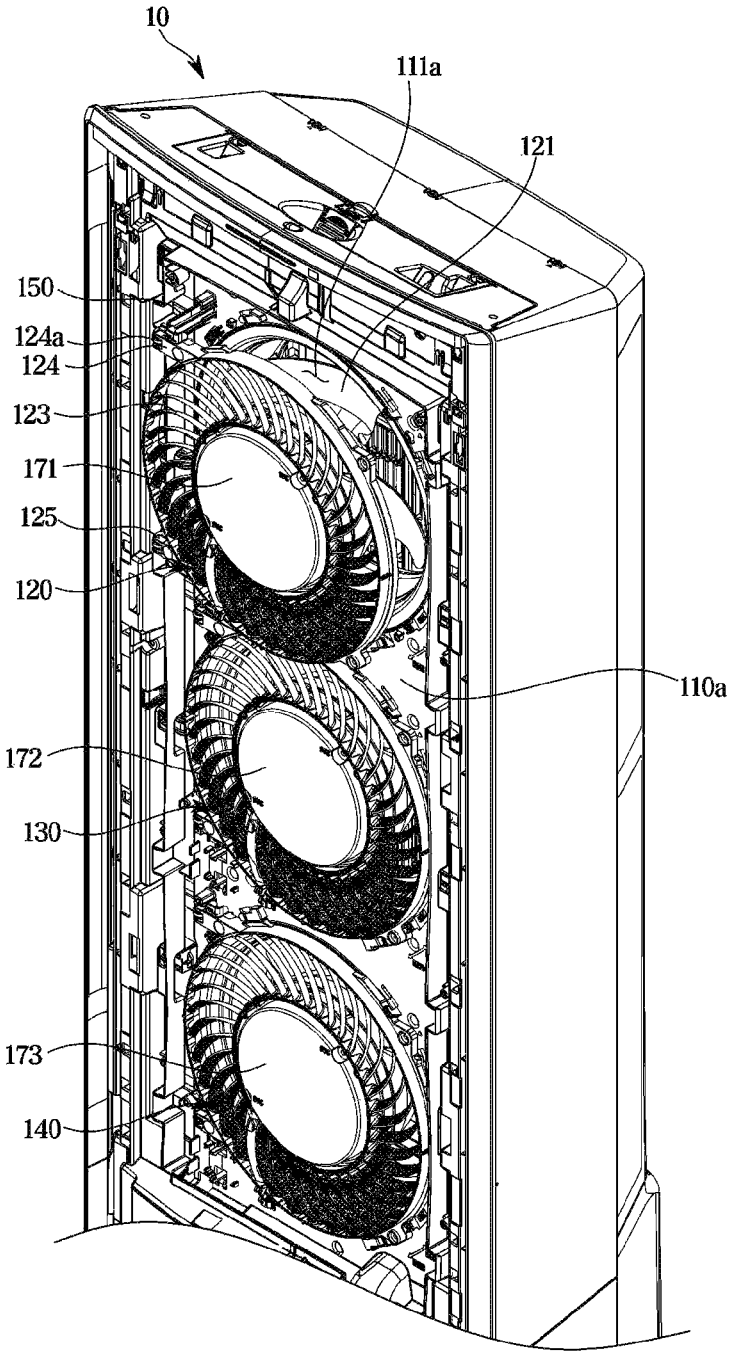
FIG. 5 is a view illustrating a state in which the fan assembly is drawn forward from the air conditioner shown in FIG. 4 according to an embodiment of the disclosure.

FIG. 5 is a view illustrating a state in which the fan assembly is drawn forward from the air conditioner shown in FIG. 4 according to an embodiment of the disclosure.

Figure 6:
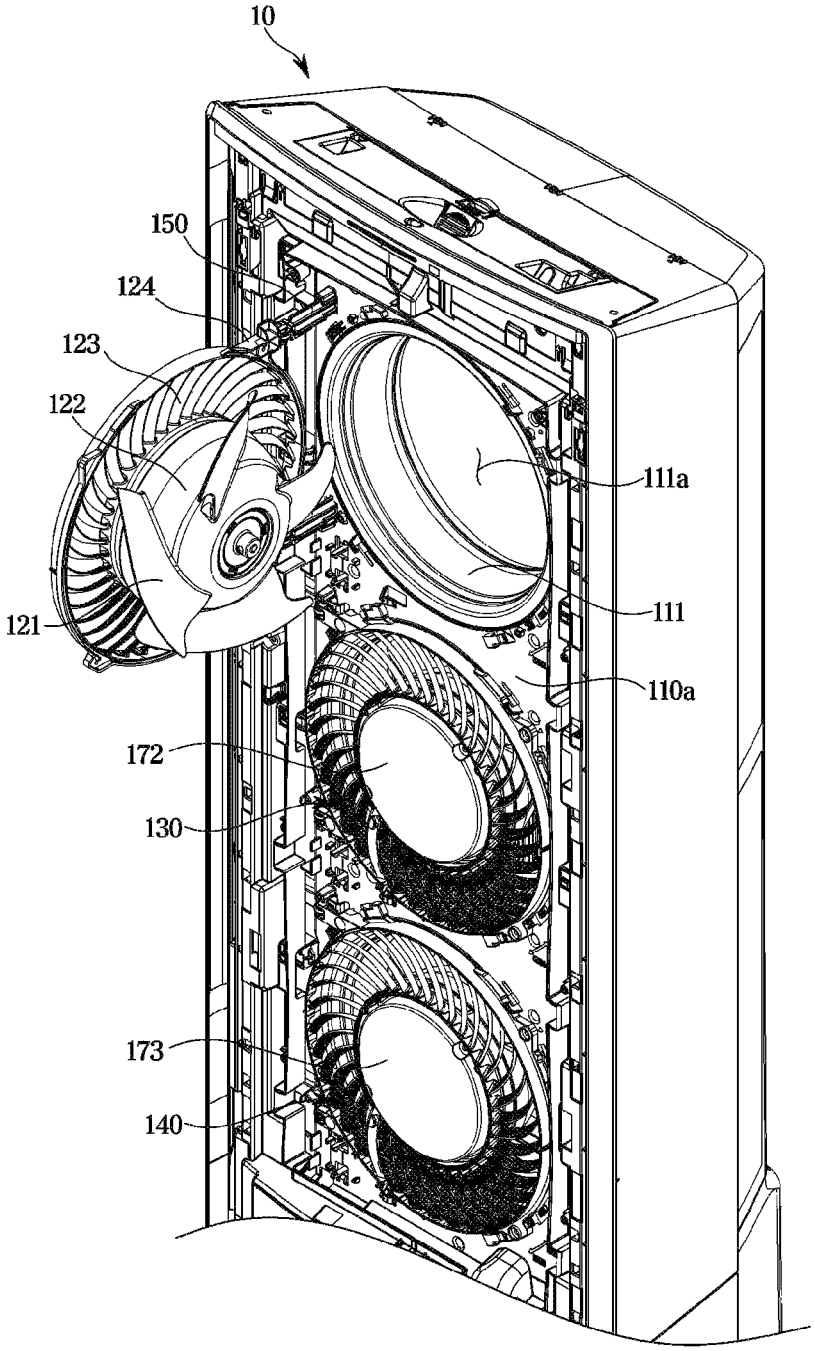
FIG. 6 is a view illustrating a state in which the fan assembly is rotated in the air conditioner shown in FIG. 5 according to an embodiment of the disclosure.

FIG. 6 is a view illustrating a state in which the fan assembly is rotated in the air conditioner shown in FIG. 5 according to an embodiment of the disclosure.

Hereinafter a process of accessing the fan and the flow path of the first duct in the air conditioner according to an embodiment of the disclosure will be described in detail with reference to FIGS. 3 to 6.

Referring to FIG. 3, the front panel 20 may be removable from the air conditioner 1. When the front panel 20 is removed, a user can access the second receiving space 13. A control box 14 may be disposed in the second receiving space 13. Inside the control box 14, a controller and a substrate for controlling the operation of the air conditioner 1 may be disposed.

A user can separate the front panel 20 from the main body 10 to clean the front panel 20. When the front panel 20 is separated from the main body 10, the cover panel 30 may cover a front surface of the first duct 110 to prevent a plurality of couplers and wires, which are disposed on the front surface 110*a* of the first duct 110, from being directly exposed to the outside.

Referring to FIG. 4, a user can separate the cover panel 30 from the main body 10 to clean the fan and the flow path. The cover panel 30 may be detachably coupled to the main body 10 in various ways. A user can separate the cover panel 30 from the main body 10 in a method suitable for each method.

Referring to FIG. 4, the air conditioner 1 according to an embodiment of the disclosure may include a first fan assembly 120, a second fan assembly 130, and a third fan assembly 140. The first fan assembly 120, the second fan assembly 130, and the third fan assembly 140 may include the same structure. Therefore, hereinafter the first fan assembly 120 will be described as an example. Further, for convenience of description, the first fan assembly 120 is referred to as the fan assembly 120.

The fan assembly 120 may be coupled to the first duct 110 by a fastening member S. The fan assembly 120 may be fixed to the first duct 110 by the fastening member S. A user can release the fixation of the fan assembly 120 to the first duct 110 by disassembling the fastening member S. The fastening member S may be a screw. However, it is not limited thereto, and there is no limitation in the structure as long as the fastening member S is configured to couple the fan assembly 120 to the first duct 110.

Referring to FIG. 5, after the fastening member S is removed, the fan assembly 120 may be drawn to the front side of the first duct 110. The fan assembly 120 may be coupled to the first duct 110 by a first link 150 to be described later. The fan assembly 120 may be rotatably coupled to the first link 150, and the first link 150 may be coupled to the first duct 110 to be movable forward or backward. By the first link 150 connecting the fan assembly 120 and the first duct 110, the fan assembly 120 may move forward or backward with respect to the first duct 110 within a predetermined distance. Further, the fan assembly 120 may be rotated with respect to the first duct 110. In other words, the fan assembly 120 may be hinged to the first duct 110.

Referring to FIG. 5, the fan assembly 120 may move forward from the first duct 110 within a predetermined distance. The predetermined distance may be determined by a length of the first link 150 in the front and rear direction. As the fan assembly 120 is drawn forward, the fan 121 may be drawn from the flow path 111*a*.

Referring to FIG. 6, the fan assembly 120 drawn to the front side of the first duct 110 may be rotated with respect to the first duct 110 so as to allow the fan 121 to be completely drawn from the flow path 111*a* in the first duct 110. Accordingly, a user can access the fan 121 of the fan assembly 120 and clean the fan 121. In addition, a user can access an inner surface 111 of the first duct 110 forming the first flow path 111*a* of the first duct 110, and can clean the inner surface 111.

According to the disclosure, it is possible to safely and easily clean the fan and the flow path by a user.

A connector disconnection process, which is conventionally performed by an expert due to the risk of electric shock, may be omitted in the air conditioner 1 according to the disclosure. That is, it is possible to safely clean the fan and flow path while maintaining the connection of the connector. This will be described later. By omitting the connector disconnection process, cleaning of the fan and flow path may be relatively easy.

In addition, because the fan assembly is required to be completely separated from the main body even after the connector is disconnected, a space for the fan assembly is required and cleaning is inconvenient in the conventional manner. According to the disclosure, it is possible to clean the fan 121 and the inner surface 111 of the first duct 110 forming the flow path 111*a* while maintaining the state in which the fan assembly 120 is coupled to the main body 10. Accordingly, a user can easily clean the fan and the flow path.

Figure 7:
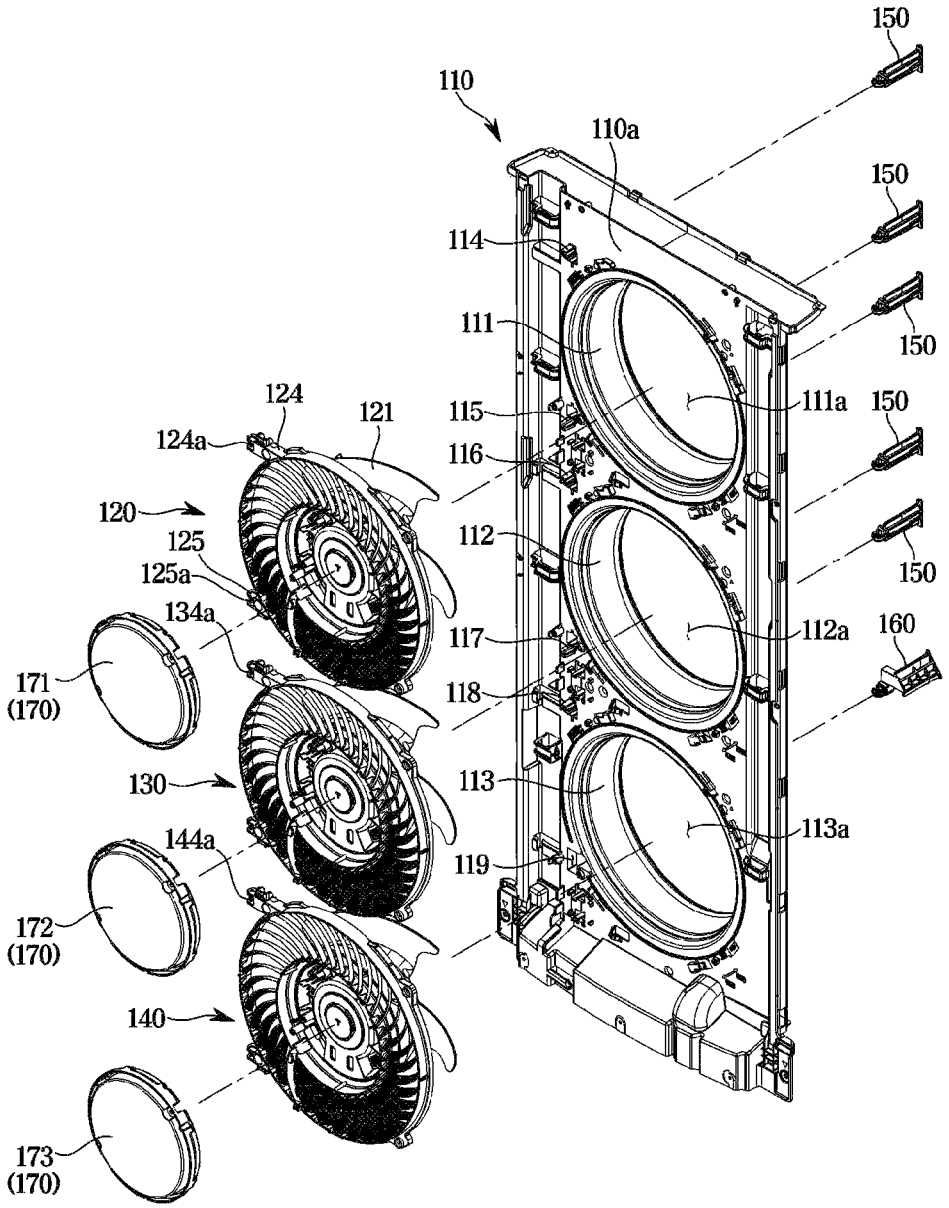
FIG. 7 is an exploded view illustrating a first duct, the fan assembly, and a link in the air conditioner according to an embodiment of the disclosure.

FIG. 7 is an exploded view illustrating a first duct, the fan assembly, and a link in the air conditioner according to an embodiment of the disclosure.

Figure 8:
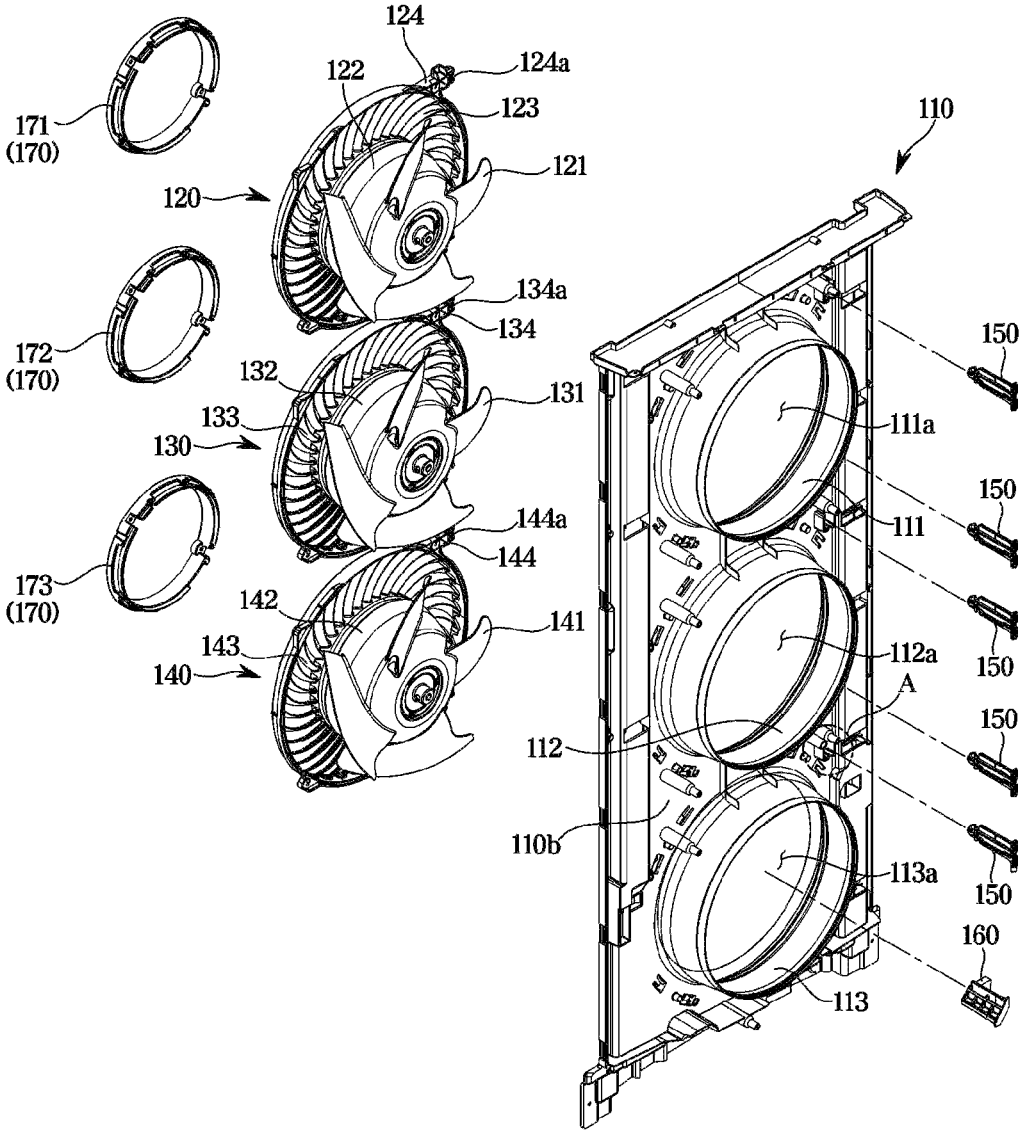
FIG. 8 is a view illustrating the first duct, the fan assembly, and the link shown in FIG. 7 when viewed from another angle according to an embodiment of the disclosure.

FIG. 8 is a view illustrating the first duct, the fan assembly, and the link shown in FIG. 7 when viewed from another angle according to an embodiment of the disclosure.

Hereinafter the configuration of the duct assembly according to an embodiment of the disclosure will be described in detail.

The duct assembly 100 may include the first duct 110, the first to third fan assemblies 120, 130 and 140 coupled to the first duct, the first link 150 and a second link 160, and a connector cover 170.

The first duct 110 may include the first flow path 111*a*, a second flow path 112*a*, and a third flow path 113*a*. The first to third flow paths 111*a*, 112*a*, and 113*a* may be provided in a circular opening shape penetrating the first duct 110. The first to third flow paths 111*a*, 112*a*, and 113*a* may guide air, which is sucked from the rear side by the first to third fan assemblies 120, 130, and 140, to the front side.

The first duct 110 may include a first link coupler 114, a second link coupler 115, a third link coupler 116, a fourth link coupler 117 and a fifth link coupler 118, which are provided to be coupled to the first link 150. The first link coupler 114, the third link coupler 116, and the fifth link coupler 118 may be provided identically. The second link coupler 115 and the fourth link coupler 117 may be provided identically.

The first link 150 may be coupled to the first to fifth link couplers 114, 115, 116, 117, and 118 to be movable in the front and rear direction. The first link 150 may be inserted from the rear side of the first to fifth link coupler 114, 115, 116, 117, and 118, and protrude to the front side of the first to fifth link couplers 114, 115, 116, 117, and 118.

The first duct 110 may include a sixth link coupler 119 to which the second link 160 is coupled. The second link 160 may be coupled to the sixth link coupler 119 to be movable in the front and rear direction. The second link 160 may be inserted from the rear side of the sixth link coupler 119 and protrude to the front side of the sixth link coupler 119.

The first duct 110 may include first to third inner surfaces 111, 112, and 113 forming the first to third flow paths 111*a*, 112*a*, and 113*a*. When the first to third inner surfaces 111, 112, and 113 are contaminated or when dust is accumulated on the first to third inner surfaces 111, 112, and 113, a user can clean the first to third inner surfaces 111, 112, and 113 through the above-mentioned process.

Because the first to third fan assemblies 120, 130, and 140 are provided identically, the first fan assembly 120 will be described as an example.

The first fan assembly 120 may include a first fan 121, a first drive motor 122 configured to rotate the first fan 121, and a first grille 123 to which the first fan 121 and the first fan drive motor 122 are coupled. In addition, the first fan assembly 120 may include a connector cover 171 coupled to the front of the first grille 123 so as to cover a connector 180 (refer to FIG. 9) to be described later. The second fan assembly 130 may include a second fan 131, a second drive motor 132, and a second grille 133. The third fan assembly 140 may include a third fan 141, a third drive motor 142, and a third grille 143.

The first grille 123 may include a pair of couplers 124 and 125 provided to be coupled to the first link 150. The pair of couplers 124 and 125 may include a first upper coupler 124 provided on an upper portion of one side of the first grille 123 and a first lower coupler 125 provided on a lower portion of one side of the first grille 123. Unlike the drawing, the first upper coupler 124 and the first lower coupler 125 may be disposed on the right side of the first grille 123 in the drawing.

The first upper coupler 124 may include a first upper shaft 124*a* coupled to the first link 150. The first lower coupler 125 may include a first lower shaft 125*a* coupled to the first link 150.

According to an embodiment of the disclosure, the air conditioner 1 may further include the second link 160 provided in a form different from the first link 150.

The first link 150 may be coupled to the first fan assembly 120 and the second fan assembly 130. Also, the first link 150 may be coupled to a third upper coupler 144 of the third fan assembly 140.

The second link 160 may be coupled to a third lower coupler (not shown) of the third fan assembly 140. That is, the second link 160 is configured to be coupled to the third lower coupler of the third fan assembly 140, and the reason for this will be described later.

Figure 9:
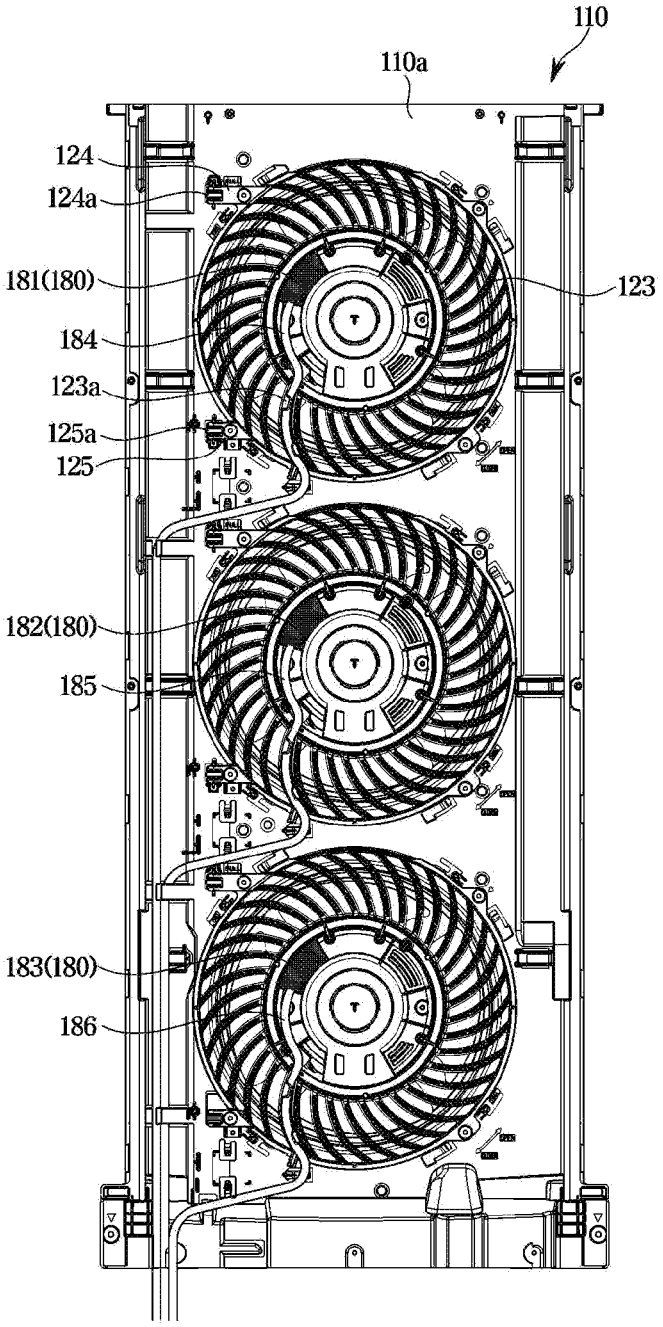
FIG. 9 is a view schematically illustrating an arrangement of a connector and a wire in the air conditioner according to an embodiment of the disclosure.

FIG. 9 is a view schematically illustrating an arrangement of a connector and a wire in the air conditioner according to an embodiment of the disclosure.

Hereinafter the arrangement of the connector and the wire according to the disclosure will be described with reference to FIG. 9.

According to an embodiment of the disclosure, a user can safely clean the fan and the inside of the duct without disconnecting the connector provided at one end of the wire for supplying power to the drive motor.

Conventionally, because the connector is exposed on the front surface of the duct, a user can come into contact with the connector while cleaning the fan and the duct. In the case of the connector, because a current flows even when the power of the air conditioner is turned off, there is a risk of electric shock due to the contact with the connector.

According to the disclosure, it is possible to prevent a user's contact with the connector 180 because the connector 180 is not exposed on the front surface of the duct.

Particularly, a first connector 181 provided at one end of a first wire 184 may be disposed in a connector receiving member (not shown) provided at one side of the center of the first grille 123. The first wire 184 connected to the first connector 181 may be guided downward of the first grille 123 by a first wire groove 123*a* provided in the first grille 123. The first wire 184 drawn from the first grille 123 may extend to one side of the front surface 110*a* of the first duct 110 and be electrically connected to a substrate (not shown) of the control box 14.

A second connector 182 and a third connector 183 may be respectively disposed on the second fan assembly 130 and the third fan assembly 140 in the same manner as the first connector 181. A second wire 185 and a third wire 186 may also extend downward to be electrically connected to the substrate (not shown) of the control box 14 in the same manner as the first wire 184.

According to an embodiment of the disclosure, the first to third wires 184, 185, and 186 may extend to the left side of the first duct 110 and then extend downward based on FIG. 9. That is, the first to third wires 184, 185, and 186 may extend to one side of the first duct 110 on which the first to third upper couplers 124, 134, and 144 and the first to third lower couplers 125, 135, and 145 are disposed. According to an embodiment of the disclosure, because the first to third upper couplers 124, 134, and 144 and the first to third lower couplers 125, 135, and 145 are disposed on the left side of the first duct 110, the first to third wires 184, 185, and 186 may disposed on the left side of the first duct 110.

According to the disclosure, the first to third fan assemblies 120, 130, and 140 may include the first connector cover to a third connector cover 171, 172, and 173, respectively. As for the first fan assembly 120, the first connector cover 171 may cover the front of the first connector 181 to prevent the first connector 181 from being exposed to the outside. The first connector cover 171 may be coupled to the front side of the first grille 123 to cover the first connector 181. Due to the structure described above, a user cannot contact the first connector 181 without removing the first connector cover 171. Because a user does not come into contact with the first connector 181, it is possible to prevent the risk of electric shock to the user. In addition, because a user cannot contact the first connector 181 structurally, there is no need to disconnect the first connector 181 for cleaning the fan or the inside of the duct. Accordingly, it is possible to simplify the process of cleaning the fan or the inside of the duct.

Figure 10:
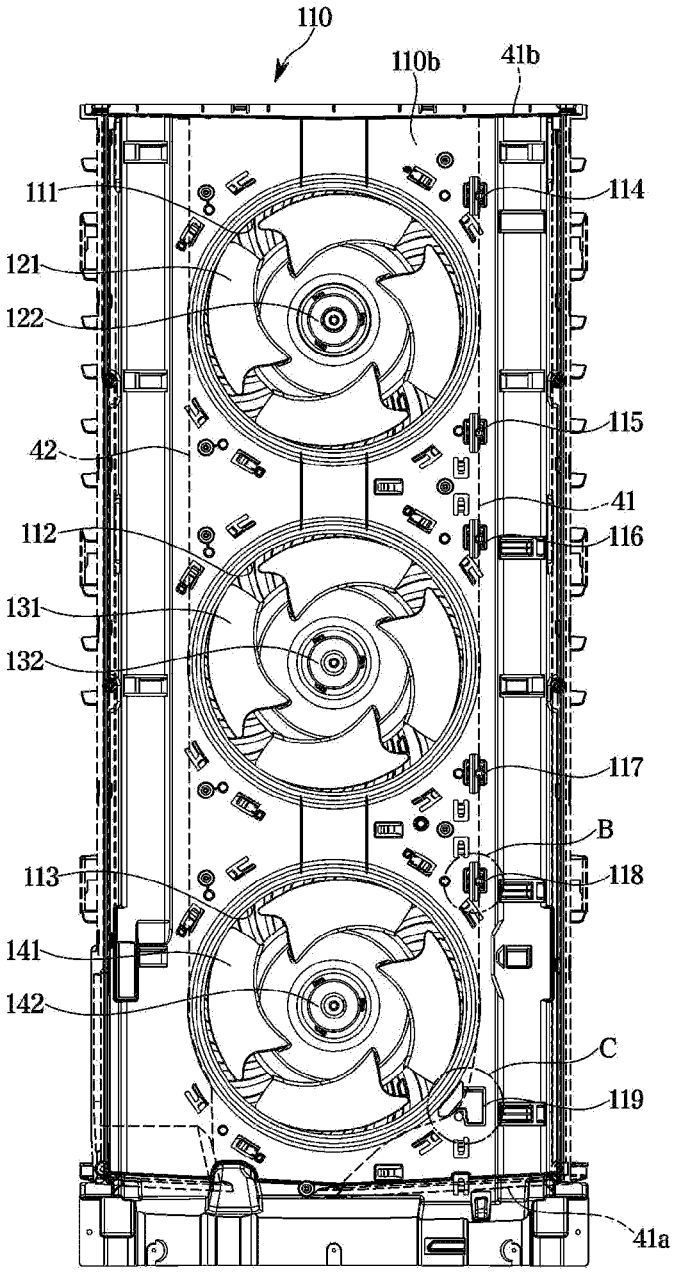
FIG. 10 is a view illustrating a rear surface of the first duct and the fan assembly in the air conditioner according to an embodiment of the disclosure.

FIG. 10 is a view illustrating a rear surface of the first duct and the fan assembly in the air conditioner according to an embodiment of the disclosure.

Referring to FIG. 10, the second duct 41 and the third duct 42 may be disposed on a rear surface 110*b* of the first duct 110. In FIG. 10, for convenience of description, the second duct 41 and the third duct 42 are indicated by dotted lines.

Referring to FIG. 10, a width of a lower end 41*a* of the second duct 41 may be greater than a width of an upper end 41*b* of the second duct 41. At this time, the width refers to the length in the left and right direction on the drawing. The second duct 41 may have the largest width at the lower end 41*a*, and the width may be reduced from the lower end 41*a* toward the upper side and then the second duct 41 may extend to the upper end 41*b* while maintaining the reduced width.

According to an embodiment of the disclosure, due to the above structure of the second duct 41, it is possible to include the second link 160 including a structure different from the first link 150. The width in a vicinity of the lower end 41*a* of the second duct 41 is large. Accordingly, when the first link 150 is coupled to the sixth link coupler 119 in a state in which the sixth link coupler 119 is provided in the same structure as the fourth link coupler 117, the first link 150 may interfere with the second duct 41. In other words, when the fourth link coupler 117 and the first link 150 are provided instead of the sixth link coupler 119 and the second link 160, the first link 150 may not move forward or backward due to the interference with the second duct 41.

According to an embodiment of the disclosure, in order to prevent the interference, the first duct 110 may include the sixth link coupler 119 including a structure different from the second and fourth link couplers 115 and 117. In addition, the air conditioner 1 may include the second link 160 provided to be coupled to the sixth link coupler 119 and including a structure different from that of the first link 150.

A difference between the fourth link coupler 117 and the first link 150, and the sixth link coupler 119 and the second link 160 will be described later.

Figure 11:
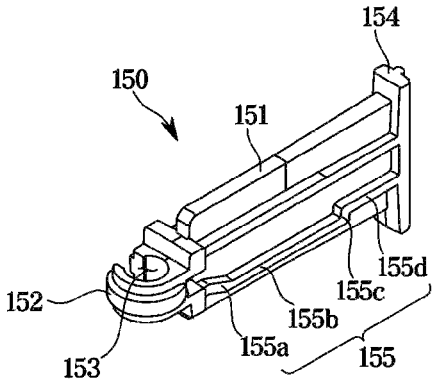
FIG. 11 is a view separately illustrating a first link in the air conditioner according to an embodiment of the disclosure.

FIG. 11 is a view separately illustrating a first link in the air conditioner according to an embodiment of the disclosure.

Figure 12:
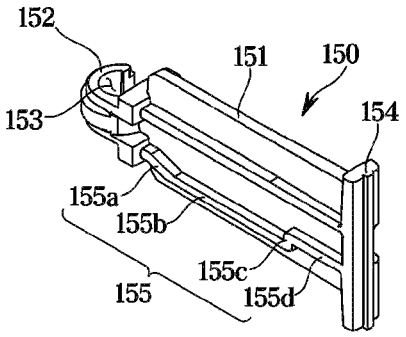
FIG. 12 is a view illustrating the first link shown in FIG. 11 when viewed from another angle according to an embodiment of the disclosure.

FIG. 12 is a view illustrating the first link shown in FIG. 11 when viewed from another angle according to an embodiment of the disclosure.

Hereinafter the structure of the first link according to an embodiment of the disclosure will be described in detail with reference to FIGS. 11 and 12.

Referring to FIGS. 11 and 12, the first link 150 according to an embodiment of the disclosure may include a body plate 151, a shaft coupler 152 provided on one end of the body plate 151, a stopper 154 provided on the other end of the body plate 151, and a guide rail 155 provided on both sides of the body plate 151.

The body plate 151 may be provided in the form of a plate having a length in a vertical direction greater than a length in a horizontal direction. The body plate 151 may extend by a predetermined length in the front and rear direction. A moving distance of the first link 150 in the front and rear direction with respect to the first duct 110 may increase in proportion to the length of the body plate 151 in the front and rear direction.

The shaft coupler 152 may be provided on end of the body plate 151. The shaft coupler 152 may be provided in the form of a pipe having one side cut. The shaft coupler 152 may include a shaft groove 153 to which shafts 124*a*, 134*a*, and 144*a* of the upper couplers 124, 134, and 144 or shafts 125*a* and 135*a* of the lower couplers 125 and 135 are inserted. The shafts 124*a*, 134*a*, 144*a*, 125*a*, and 135*a* may be fitted and coupled to the shaft groove 153 through the cut side of the shaft coupler 152.

On the other end of the body plate 151, the stopper 154 provided to limit a moving distance of the first link 150 with respect to the first duct 110 may be arranged. The stopper 154 may prevent the first link 150 from being drawn to the front side of the first duct 110 from the rear side of the first duct 110 through the first duct 110. That is, the stopper 154 may be provided to have an area greater than a size of a coupling hole 118*a* (refer to FIG. 15) of the first to fifth link couplers 114, 115, 116, 117, and 118.

The guide rail 155 may be arranged on a side surface of the body plate 151. The guide rail 155 may include an inclined member 155*a*, a first horizontal member 155*b*, a stepped member 155*c*, and a second horizontal member 155*d* arranged sequentially from the front side to the rear side.

The inclined member 155*a* may be provided to be inclined downward from the front side to the rear side. The first horizontal member 155*b* and the second horizontal member 155*d* may be provided horizontally, respectively. In addition, the stepped member 155*c* may connect the second horizontal member 155*d* and the first horizontal member 155*b* but may extend in the vertical direction. The second horizontal member 155*d* may be disposed higher than the first horizontal member 155*b*.

By the structure of the guide rail 155 described above, when the first link 150 is drawn to the front side of the first duct 110, the first link 150 moves upward by the inclined member 155*a*, and then moves downward by the stepped member 155*c*. After the first link 150 is drawn to the front side of the first duct 110, the backward movement of the first link 150 is restricted by the stepped member 155*c*. In order to insert the first link 150 back to the rear side, it is required for the first link 150 to move upward by the vertical length of the stepped member 155*c* or more, and then to move backward. That is, the inclined member 155*a* and the stepped member 155*c* may prevent the first link 150 from moving forward and backward without being fixed to the first duct 110. In other words, the inclined member 155*a* and the stepped member 155*c* may temporarily fix the first link 150 so as to prevent the first link 150 from moving forward and backward with respect to the first duct 110.

Figure 13:
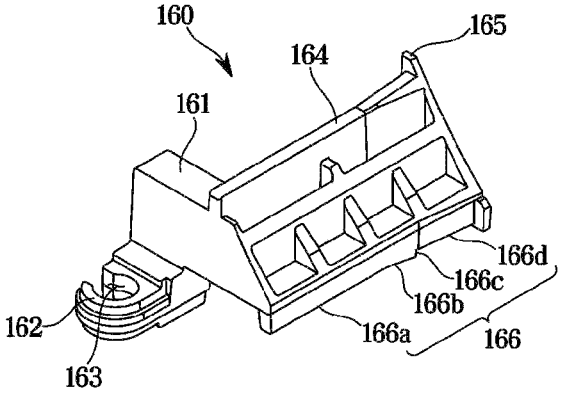
FIG. 13 is a view separately illustrating a second link in the air conditioner according to an embodiment of the disclosure.

FIG. 13 is a view separately illustrating a second link in the air conditioner according to an embodiment of the disclosure.

Figure 14:
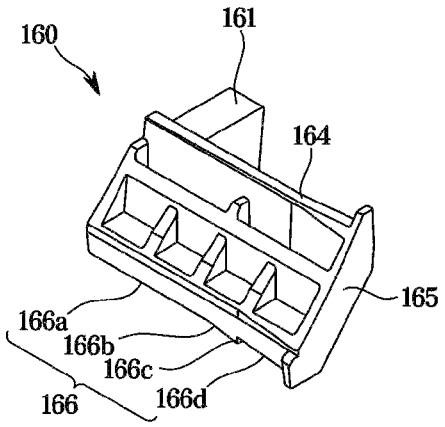
FIG. 14 is a view illustrating the second link shown in FIG. 13 when viewed from another angle according to an embodiment of the disclosure.

FIG. 14 is a view illustrating the second link shown in FIG. 13 when viewed from another angle according to an embodiment of the disclosure.

Hereinafter the structure of the second link according to an embodiment of the disclosure will be described in detail with reference to FIGS. 13 and 14.

Referring to FIGS. 13 and 14, the second link 160 according to an embodiment of the disclosure may include a plate member 161, a shaft coupler 162 provided on one side of the plate member 161, a rail member 164 extending in a direction substantially perpendicular to the first plate 161 from the other side of the plate member 161, a stopper 165 provided at one end of the rail member 164, and a guide rail 166.

The plate member 161 may extend in the horizontal direction. The shaft coupler 162 may be provided at one end of the plate member 161 extending in the horizontal direction, and the rail member 164 may be provided at the other end of the plate member 161. Accordingly, the second link 160 may allow the shaft coupler 162 and the rail member 164 to be spaced apart from each other in the horizontal direction. The second link 160 allows the shaft coupler 162 and the rail member 164 to be spaced apart from each other in the horizontal direction, and thus when the second link 160 moves forward and backward with respect to the first duct 110, the second link 160 may not interfere with the second duct 41. This will be described more details with reference to FIG. 17.

The shaft coupler 162 may be provided in the form of a pipe having one side cut. The shaft coupler 162 may include a shaft groove 163 into which a shaft (not shown) of a third lower coupler (not shown) is inserted. The shaft may be fitted into the shaft groove 163 through the cut side of the shaft coupler 162.

The rail member 164 may extend from one end of the plate member 161 in a direction perpendicular to the direction in which the plate member 161 extends. In other words, the plate member 161 may extend in the horizontal direction, and the rail member 164 may extend in the front and rear direction.

One end of the rail member 164 may be connected to the plate member 161, and the stopper 165 may be provided at the other end of the rail member 164. The stopper 165 may prevent the second link 160 from being drawn from the rear side of the first duct 110 toward the front of the first duct 110 through the first duct 110. For this, the stopper 165 may be provided to have an area greater than a size of a coupling hole (not shown) of the sixth coupler 119.

The rail member 164 may include a guide rail 166 extending from a lower surface of the rail member 164. The guide rail 166 may include a horizontal member 166*a*, a first inclined member 166*b*, a stepped member 166*c*, and a second inclined member 166*d*, which are sequentially provided from the front side to the rear side. The horizontal member 166*a* may horizontally extend in the front and rear direction, and the first inclined member 166*b* may be provided to be inclined downward from the front side to the rear side. The stepped member 166*c* may extend upward from one end of the first inclined member 166*b*, and the second inclined member 166*d* may be provided to be inclined downward from the stepped member 166*c* to the rear side. However, it is not limited thereto, and the horizontal member 166*a* and the first inclined member 166*b* may form one inclined member, and the second inclined member 166*d* may extend horizontally.

Due to the above-mentioned structure of the rail member 166, when the second link 160 is drawn to the front side of the first duct 110, the second link 160 may move upward by the first inclined member 166*b* and then move downward again by the stepped member 166*c*. After the second link 160 is drawn to the front side of the first duct 110, the backward movement of the second link 150 is restricted by the stepped member 166*c*. In order to insert the second link 160 back to the rear side, it is required for the second link 160 to move upward by the vertical length of the stepped member 166*c* or more, and then to move backward. That is, the inclined member 166*a* and the stepped member 166*c* may prevent the second link 160 from moving forward and backward without being fixed to the first duct 110. In other words, the inclined member 166*a* and the stepped member 166*c* may temporarily fix the second link 160 so as to prevent the second link 160 from moving forward and backward with respect to the first duct 110.

Figure 15:
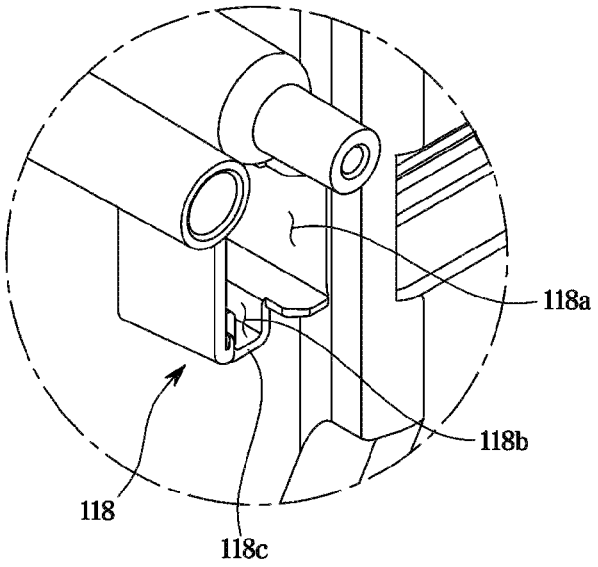
FIG. 15 is an enlarged view of part A of FIG. 8 according to an embodiment of the disclosure.

FIG. 15 is an enlarged view of part A of FIG. 8 according to an embodiment of the disclosure.

Referring to FIG. 15, the fifth link coupler 118 may include a coupling hole 118*a* penetrating the first duct 110 in the front and rear direction. The coupling hole 118*a* may further include a coupling groove 118*b* into which the body plate 151 of the first link 150 is inserted. The coupling groove 118*b* may be provided to correspond to the body plate 151, and the coupling hole 118*a* may be provided to correspond to the first link 150 to allow the first link 150 to move in the front and rear direction within the coupling hole 118*a*.

The fifth link coupler 118 may further include a protrusion 118*c* provided to limit a range, in which the first link 150 moves forward, by being in contact with the stopper 154 of the first link 150.

Figure 16:
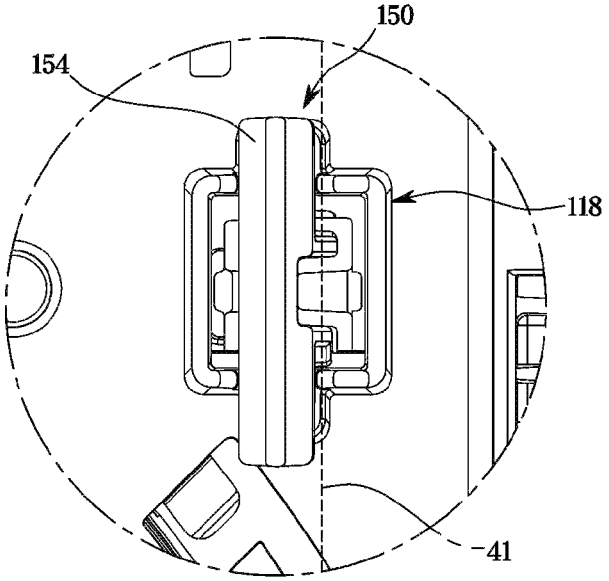
FIG. 16 is an enlarged view of part B of FIG. 10 according to an embodiment of the disclosure.

FIG. 16 is an enlarged view of part B of FIG. 10 according to an embodiment of the disclosure.

Referring to FIG. 16, when the first link 150 is coupled to the fifth link coupler 118, the second duct 41 may not prevent the forward and backward movement of the first link 150. Because the stopper 154 of the first link 150 is provided so as not to be in contact with the second duct 41, the second duct 41 may not limit the forward or backward movement of the first link 150.

Figure 17:
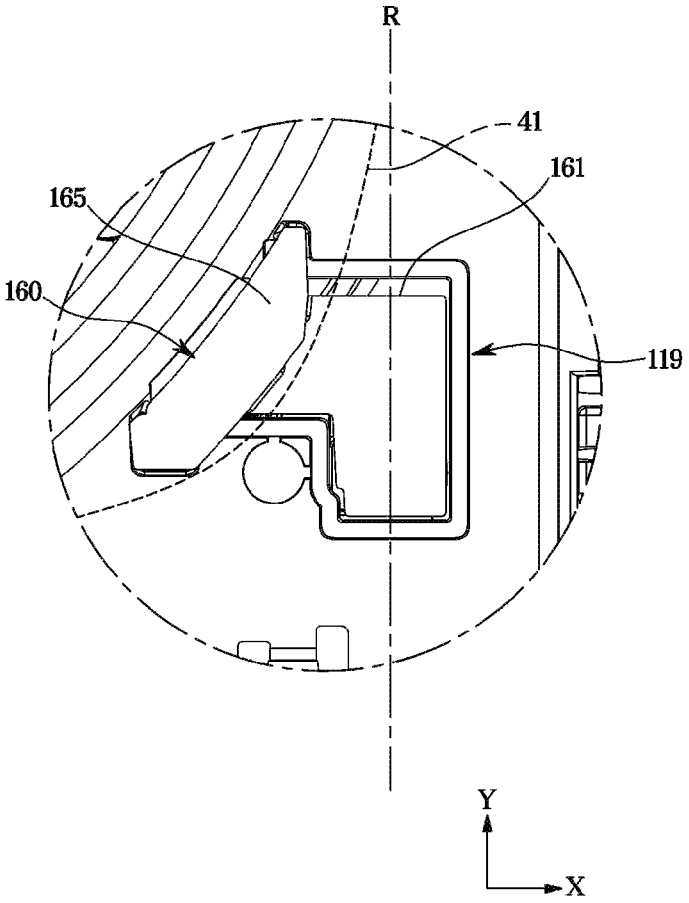
FIG. 17 is an enlarged view of part C of FIG. 10 according to an embodiment of the disclosure.

FIG. 17 is an enlarged view of part C of FIG. 10 according to an embodiment of the disclosure.

Referring to FIG. 17, when the second link 160 is coupled to the sixth link coupler 119, the second duct 41 may not prevent the forward and backward movement of the second link 160. Referring to FIG. 17, the second duct 41 in an area adjacent to the sixth link coupler 119 may overlap a rotation axis R of the third fan assembly 140 in the front and rear direction. Due to this, when the same structure as the first link 150 and the fifth link coupler 118 is applied to the position of the sixth link coupler 119, the forward and backward movement of the first link 150 is restricted by the interference with the second duct 41.

According to an embodiment of the disclosure, the second link 160 may include the plate member 161 extending in the horizontal direction, and the shaft coupler 162 and the rail member 164 may be provided at both ends of the plate member 161, respectively. Due to this structure, the shaft coupler 162 and the rail member 164 may be spaced apart from each other in the horizontal direction. Because the shaft coupler 162 and the rail member 164 are spaced apart in the horizontal direction, the second link 160 may move forward or backward with respect to the first duct 110 without the interference with the second duct 41 while maintain the rotation axis R of the third fan assembly 140.

Due to the above-mentioned structure, when the second link 160 moves forward and backward, the stopper 165 of the second link 160 may not come into contact with the second duct 41.

Meanwhile, the horizontal direction may indicate the X-axis direction shown in FIG. 17, and the vertical direction may indicate the Y-axis direction.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An air conditioner comprising:

a hinge;

a duct; and a fan assembly hinged to the duct via the hinge, the hinge being provided on one side edge of the fan assembly, wherein the fan assembly comprises:

a fan configured to suction and discharge air, a drive motor configured to rotate the fan, a fan frame to which the fan and the drive motor are mounted, the fan frame including a grill member and a wire groove, the grill member including a plurality of ribs spaced apart from one another and configured to allow air to be discharged through the fan frame, at least part of the wire groove being provided in the grill member along a first rib among the plurality of ribs, and a wire connected to the drive motor to supply power to the drive motor, wherein at least a portion of the wire is disposed inside the at least part of the wire groove provided in the grill member, and wherein the wire groove guides the wire along the first rib of the grill member towards the one side edge of the fan assembly including the hinge.

2. The air conditioner of claim 1, wherein the duct includes a circular opening, and wherein the fan is drawn from the circular opening as the fan assembly and rotationally moves with respect to the duct.

3. The air conditioner of claim 1, further comprising:

a link provided to connect the fan assembly and the duct to allow the fan assembly to be coupled to the duct, and provided to connect the fan assembly and the duct to allow the fan assembly to linearly move and rotationally move with respect to the duct, wherein the fan frame comprises a shaft provided to serve as a rotation axis of the fan assembly, and wherein the link comprises a shaft coupler provided to allow the shaft to be coupled thereto.

4. The air conditioner of claim 3, wherein the duct comprises a link coupler formed to penetrate the duct to allow the link to be inserted thereinto, and wherein the link further comprises a stopper provided to be larger than the link coupler to prevent the link from passing through the link coupler.

5. The air conditioner of claim 4, wherein, based on the link moving linearly in a first direction, the link comprises:

a body plate extending in the first direction;

the shaft coupler provided at a first end of the body plate; and the stopper provided at a second end of the body plate.

6. The air conditioner of claim 4, wherein, based on the link moving linearly in a first direction, the link comprises:

a plate member extending in a second direction perpendicular to the first direction;

the shaft coupler provided at a first end of the plate member; and a rail member provided at a second end of the plate member and extending in the first direction.

7. The air conditioner of claim 6, wherein the rail member is provided to linearly move in the first direction within the link coupler, and wherein the rotation axis and the rail member are provided to be spaced apart from each other by a predetermined distance in the second direction.

8. The air conditioner of claim 1, wherein the fan frame is provided to cover a flow path of the duct in response to the fan assembly being coupled to the duct.

9. The air conditioner of claim 1, further comprising:

a connector electrically connected to the drive motor to supply electric power to the drive motor, wherein the fan frame comprises a connector receiving member provided to receive the connector.

10. The air conditioner of claim 9, further comprising:

a connector cover provided to cover the connector receiving member to prevent the connector from being exposed to an outside.

11. The air conditioner of claim 10, wherein, in response to the fan assembly linearly and rotationally moving with respect to the duct, the connector and the connector cover are provided to linearly and rotationally move together with the fan assembly.

12. The air conditioner of claim 1, further comprising:

a main body; and a front panel detachably coupled to the main body and provided to cover a front surface of the main body.

13. The air conditioner of claim 12, further comprising:

a heat exchanger disposed inside the main body, wherein the duct is disposed inside the main body between the front panel and the heat exchanger to face the front panel and the heat exchanger.

14. The air conditioner of claim 12, wherein the front panel comprises a plurality of holes provided to discharge air discharged by the fan, and wherein the front panel is disposed to face the duct.

15. The air conditioner of claim 1, further comprising:

a fastening member fastened to the duct to fix the fan assembly to the duct.

16. The air conditioner of claim 15, wherein the fan assembly is provided to linearly and rotationally move after a fastening of the fastening member is released.

17. The air conditioner of claim 1, wherein the fan frame includes a joint configured to couple the hinge to the fan frame, and wherein the wire extends along a same side of the fan frame as the hinge.

18. The air conditioner of claim 1, further comprising:

a cover disposed to cover a front of the fan assembly and detachably coupled to the fan assembly.

19. The air conditioner of claim 18, further comprising:

a plurality of couplings provided at the front of the duct, wherein the cover is arranged to prevent the wire from exposure to an outside of the air conditioner while the cover is coupled to the fan assembly.

20. The air conditioner of claim 18, wherein the duct comprises a plurality of holes provided to discharge air discharged by the fan, and wherein the cover is disposed to face the duct.

21. The air conditioner of claim 1, further comprising:

a connector cover coupled to a front of the fan assembly so as to prevent an end of the wire from being exposed to an outside.

22. The air conditioner of claim 15, wherein each rib of the plurality of ribs comprises a curved portion for guiding the air discharged through the fan frame.

* * * * *